US010247365B2

(12) United States Patent
Liu et al.

(10) Patent No.: US 10,247,365 B2
(45) Date of Patent: Apr. 2, 2019

(54) LED FILAMENT AND LED FILAMENT LIGHT CONTAINING THE SAME

(71) Applicant: Shandong Prosperous Star Optoelectronics Co., Ltd., Taian, Shandong (CN)

(72) Inventors: Boren Liu, Zhongshan (CN); Xincheng Yuan, Taian (CN); Yiping Kong, Taian (CN)

(73) Assignee: Shandong Prosperous Star Optoelectronics Co., Ltd., Taian (CN)

( * ) Notice: Subject to any disclaimer, the term of this patent is extended or adjusted under 35 U.S.C. 154(b) by 163 days.

(21) Appl. No.: 15/469,592

(22) Filed: Mar. 27, 2017

(65) Prior Publication Data

US 2017/0276298 A1 Sep. 28, 2017

Related U.S. Application Data

(63) Continuation of application No. PCT/CN2016/000158, filed on Mar. 22, 2016.

(30) Foreign Application Priority Data

Mar. 23, 2015 (CN) ..... 2015 1 0136170
Jan. 23, 2016 (CN) ..... 2016 1 0056569

(51) Int. Cl.
*F21K 9/237* (2016.01)
*F21K 9/232* (2016.01)
(Continued)

(52) U.S. Cl.
CPC ..... *F21K 9/237* (2016.08); *F21K 9/232* (2016.08); *F21K 9/238* (2016.08); *F21K 9/90* (2013.01); *F21V 3/02* (2013.01); *F21V 3/061* (2018.02); *F21V 17/101* (2013.01); *F21V 17/105* (2013.01); *F21V 19/003* (2013.01);
(Continued)

(58) Field of Classification Search
CPC . F21K 9/237; F21K 9/90; F21K 9/232; F21K 9/238; F21V 19/003; F21V 19/005; F21V 3/061; F21V 3/02; F21V 23/06; F21V 23/001; F21V 17/105; F21V 17/101;
(Continued)

(56) References Cited

U.S. PATENT DOCUMENTS

2017/0167667 A1* 6/2017 Ma ..... F21V 3/00
2017/0191623 A1* 7/2017 Ma ..... F21K 9/237

* cited by examiner

*Primary Examiner* — David V Bruce
(74) *Attorney, Agent, or Firm* — Wayne & Ken, LLC; Tony Hom

(57) ABSTRACT

An LED filament, comprising a plurality of light-emitting chips, a metal electrical terminal, a fluorescent glue, an insulating substrate and an electrically and magnetically conductive connector. The plurality of light-emitting chips are connected in series, and encapsulated and fixed on a surface of the insulating substrate by the fluorescent glue, one face of the electrically and magnetically conductive connector is fitted on the other surface of the insulating substrate, the metal electrical terminal is electrically connected to a light-emitting chip at one end of the insulating substrate. Also provided is an LED filament light, comprising a plurality of LED filaments and a permanent magnet. The LED filaments are magnetically and movably connected by means of magnetic attraction via the permanent magnet, and are capable of automatic sliding adjustment during thermal expansion and elongation.

16 Claims, 8 Drawing Sheets

(51) Int. Cl.

| | |
|---|---|
| ***F21K 9/238*** | (2016.01) |
| ***F21V 3/06*** | (2018.01) |
| ***F21V 3/02*** | (2006.01) |
| ***F21V 17/10*** | (2006.01) |
| ***F21V 23/00*** | (2015.01) |
| ***F21V 23/06*** | (2006.01) |
| ***F21K 9/90*** | (2016.01) |
| ***F21V 19/00*** | (2006.01) |
| *F21Y 115/10* | (2016.01) |
| *F21Y 103/10* | (2016.01) |
| *F21Y 107/00* | (2016.01) |
| *F21Y 109/00* | (2016.01) |

(52) U.S. Cl.
CPC ..... *F21V 19/005* (2013.01); *F21V 23/001* (2013.01); *F21V 23/06* (2013.01); *F21Y 2103/10* (2016.08); *F21Y 2107/00* (2016.08); *F21Y 2109/00* (2016.08); *F21Y 2115/10* (2016.08)

(58) Field of Classification Search
CPC ..... F21Y 2109/00; F21Y 2107/00; F21Y 2103/00; F21Y 2115/10
See application file for complete search history.

LED FILAMENT AND LED FILAMENT LIGHT CONTAINING THE SAME

TECHNICAL FIELD

The present invention belongs to light field, and more specifically, to an LED filament and LED filament light.

BACKGROUND OF THE PRESENT INVENTION

LED filament light is also called 360-degree full peripheral light in the industry, and is one of ideal energy saving lamps which can replace existing incandescent lamp. The LED filament light is generally made up of a lamp cap connecting the electric supply, an LED power supply installed inside the lamp cap, a glass bulb, a glass stem fixedly in the glass bulb and embedded with a positive wire and a negative wire, and a plurality of LED filaments electrically connected to the positive wire and the negative wire and fixedly on the glass stem. LED filament is emitted via rectification and transformation of the electric supply. LED filament is made by connecting a plurality of light-emitting chips in series, fixing on a thinner substrate and sealing with fluorescent glue. LED filaments with different quantities and light with different powers can be designed based on multiple combination modes between filaments, such as series connection, parallel connection or series connection and parallel connection etc.

About existing LED filament lights, except a main section of light-emitting section in the middle, both ends of the filament are provided with a small section of metal power terminal for soldering without encapsulating fluorescent glue, and they are non-luminous, even for LED filament of non-metal substrate such as sapphire, glass or ceramics, both ends are provided with the section of metal power terminal for soldering. These two sections are used as power connection point to connect between filaments by spot welding. And these power terminals for soldering occupy certain space, so that the light illumination direction generates shadows and weak light region naturally, that is, light illumination is not uniform, and the LED filament light called 360-degree full periphery has obvious defects. LED filament light with opposed structure of two filaments is existed to weaken shadows and light region of light illumination direction; and common multiple pairs of LED filament light, such as 2 pairs, 3 pairs and 4 pairs etc., generally distributes the filament as truncated cone-shaped structure, and shadows in light illumination direction is more obvious, even one direction in three-dimensional illumination lacks of light; and there are some structures that each pair of LED filament is soldered into human-shaped and connected in parallel or in series. In conclusion, due to the existence of non-luminous soldering terminal, corresponding place is occupied and light illumination is blocked, so that shadows and weak light region is formed, and obvious nonuniform light illumination effect is generated.

Meanwhile, existing LED filament lights adopt many spot welding technologies, which is complicate. And after both ends of each filament is rigidly soldered, the LED filament is expanded and contracted repeatedly due to heat at work, so that the filament bends and deforms repeatedly, and the service life is greatly affected.

SUMMARY OF THE PRESENT INVENTION

The purpose of the present invention is to provide an LED filament, which can be applied to LED filament light and has characteristics of less solder joint and long service life.

The purpose of the present invention is realized as follows: an LED filament, comprising a plurality of light-emitting chips, a metal electrical terminal, a fluorescent glue, an insulating substrate and an electrically and magnetically conductive connector.

The plurality of light-emitting chips are connected in series, and encapsulated and fixed on a surface of the insulating substrate by the fluorescent glue, one face of the electrically and magnetically conductive connector is bonded the other surface of the insulating substrate; the metal electrical terminal is electrically connected to a light-emitting chip at one end of the insulating substrate, and the electrically and magnetically conductive connector is electrically connected to the light-emitting chip at the other end of the insulating substrate.

The LED filament has a specialty that the electrically and magnetically conductive connector is strip-shaped.

The LED filament further comprises an insulating seat, one side of the insulating seat is fixedly connected to the metal electrical terminal, and the other side of the insulating seat is fixedly connected to the electrically and magnetically conductive connector; one surface of the electrically and magnetically conductive connector is exposed for convenient for magnet attraction.

The specialty of the LED filament is that the electrically and magnetically conductive connector is provided with a first clamping slot, and the metal electrical terminal is provided with a second clamping slot; one end portion of the insulating substrate is arranged in the first clamping slot and the other end portion of the insulating substrate is mounted in the second clamping slot; one surface of the first clamping slot is exposed for convenient for magnet attraction.

Another purpose of the present invention is to provide an LED filament light, the light has no blocking component, so that shades and a weak light region are not generated in a light illumination direction, and furthermore, the uniform. three-dimensional light illumination effect is obtained.

An LED filament light, comprising a lamp cap connecting the electric supply, an LED power supply installed inside the lamp cap, a glass bulb, a glass stem fixedly in the glass bulb and embedded with a positive wire and a negative wire, and a plurality of LED filaments electrically connected to the positive wire and the negative wire and fixedly on the glass stem, and the LED filaments comprises an anode LED filament group and a cathode LED filament group;

One electric terminal of the LED filament of the anode LED filament group is electrically connected to the positive wire.

One electric terminal of the LED filament of the cathode LED filament group is electrically connected to the negative wire.

The LED filament further comprises a permanent magnet, and the other electric terminal of the LED filaments of the anode group and the electric terminal of the LED filaments of the cathode group are connected in series by magnetic attraction by the permanent magnet through die electrically and magnetically conductive connector.

Another LED filament light of the present invention comprises a lamp cap, an LED power supply installed inside the lamp cap, a glass bulb, a glass stem fixedly in the glass bulb and embedded with a positive wire and a negative wire, and a plurality of LED filaments electrically connected to the positive wire and the negative wire and fixedly On the glass stem, one end of the LED filament provided with a metal electrical terminal for welding is arranged close to the lamp cap, and the LED filament light further comprises at least two permanent magnets, and the other ends away from the lamp cap of a pair of LED filaments are connected in series by magnetic attraction by each of the permanent magnet through the electrically and magnetically conductive connector; one metal electrical terminal of one pair of LED filaments are electrically connected to the positive wire, and one metal electrical terminal of another pair of LED filaments are electrically connected to the negative wire, and other two adjacent pairs of metal electrical terminal are electrically connected by a wire.

The beneficial effect of the present invention is that LED filaments have free slipping and adjusting function when the lamp filaments are thermally expanded and extended, thereby overcoming the problem of shortened service life due to repeated bending deformation of the LED filaments. Besides, the spot welding connection of one end of the LED filaments and multi-point soldering of a plurality of LED filaments connected in parallel and in series are replaced by permanent magnet attraction connection, thereby simplifying the manufacturing process.

Particularly, the common spot welding part with non-luminance and light blocking of one end of the LED filament away from the lamp cap is cancelled, and the top end of a conical luminous body also has luminous efficacy, so that shades and a weak light region are prevented from being generated in the lighting direction, so as to obtain an LED filament light with a uniform three-dimensional lighting effect.

Furtherly, the plurality of LED filaments are extended from a top end of a conical body, so that the filaments are cross distribution, thereby forming an LED filament light with better light shape.

DETAILED DESCRIPTION OF THE PRESENT INVENTION

The present invention is further described in detail in combination with drawings.

Figure 1:
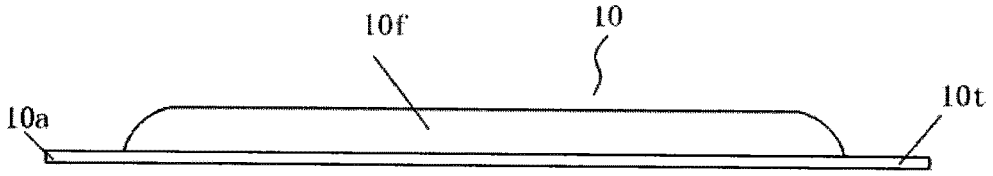
FIG. 1 is a structure diagram of existing LED filament.

As shown in FIG. 1, both ends of an LED filament 10 are provided with power terminals 10*a* and 10*t* fit dedicated to soldering, which are non-luminous and block the light, and one section encapsulated with a fluorescent glue 10*f* is a light-emitting section.

Figure 2:
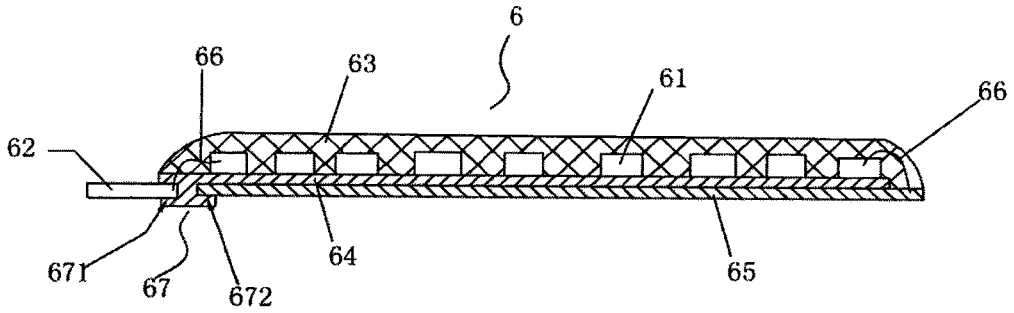
FIG. 2 is a structure diagram of an embodiment provided by LED filament of the present invention.

FIG. 2 shows a structure diagram of an embodiment provided by the LED filament. An LED filament 6 comprises a plurality of light-emitting chips 61, a metal electrical terminal 62, a fluorescent glue 63, an insulating substrate 64 and an electrically and magnetically conductive connector 65; the plurality of light-emitting chips 61 are connected in series, and encapsulated and fixed OR a surface of the insulating substrate 64 by the fluorescent glue 63, one face of the electrically and magnetically conductive connector 65 is bonded the other surface of the insulating substrate 64; the metal electrical terminal 62 is electrically connected to a light-emitting chip 61 at one end of the insulating substrate 64, and the electrically and magnetically conductive connector (65) is electrically connected to the light-emitting chip 61 at the other end of the insulating substrate 64.

Preferably, the metal electrical terminal 62 is connected to a light-emitting chip 61 at one end of the insulating substrate 64 by a wire 66, preferably, the electrically and magnetically conductive connector 65 is connected to the light-emitting chip 61 at the other end of the insulating substrate 64 by another wire 66.

The electrically and magnetically conductive connector 65 is rectangle, or strip-shaped.

The LED filament further comprises an insulating seat 67, one side of the insulating seat 67 is fixedly connected to the metal electrical terminal 62, and the other side of the insulating seat 67 is fixedly connected to the electrically and magnetically conductive connector 65.

One side of the insulating seat 67 is provided with, a mounting slot 671, and the other side of the insulating seat 67 is provided with another mounting slot 672, the metal electrical terminal 62 is embedded with the mounting slot 671, and one end of the electrically and magnetically conductive connector 65 is embedded with the mounting slot 672. The LED filament 6 of this embodiment is used for light, and the electrically and magnetically conductive connector 65 is magnetically and movably connected, so that the filaments have free slipping and adjusting function when the filaments are thermally expanded and extended, thereby overcoming the problem of shortened service life due to repeated bending deformation of the LED filaments.

Figure 3:
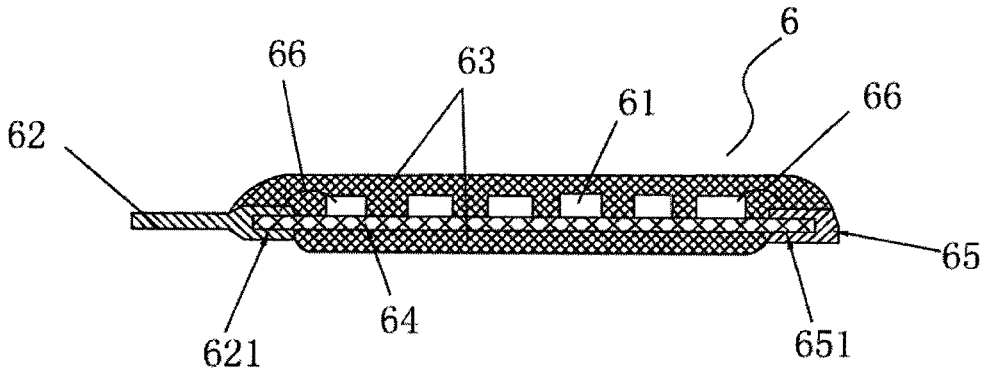
FIG. 3 is a structure diagram of another embodiment provided by LED filament of the present invention.

FIG. 3 shows a structure diagram of another embodiment provided by the LED filament. The electrically and magnetically conductive connector 65 is provided with a first clamping slot 651, and the metal electrical terminal 62 is provided with a second clamping slot 621; one end portion of the insulating substrate 64 is mounted in the first clamping slot 651 and the other end portion of the insulating substrate 64 is arranged in the second clamping slot 621. The LED filament 6 of this embodiment is used for light, and the electrically and magnetically conductive connector 65 is magnetically and movably connected, so that the filaments have free slipping and adjusting function when the filaments are thermally expanded and extended, thereby overcoming the problem of shortened service life due to repeated bending deformation of the LED filaments.

Figure 4:
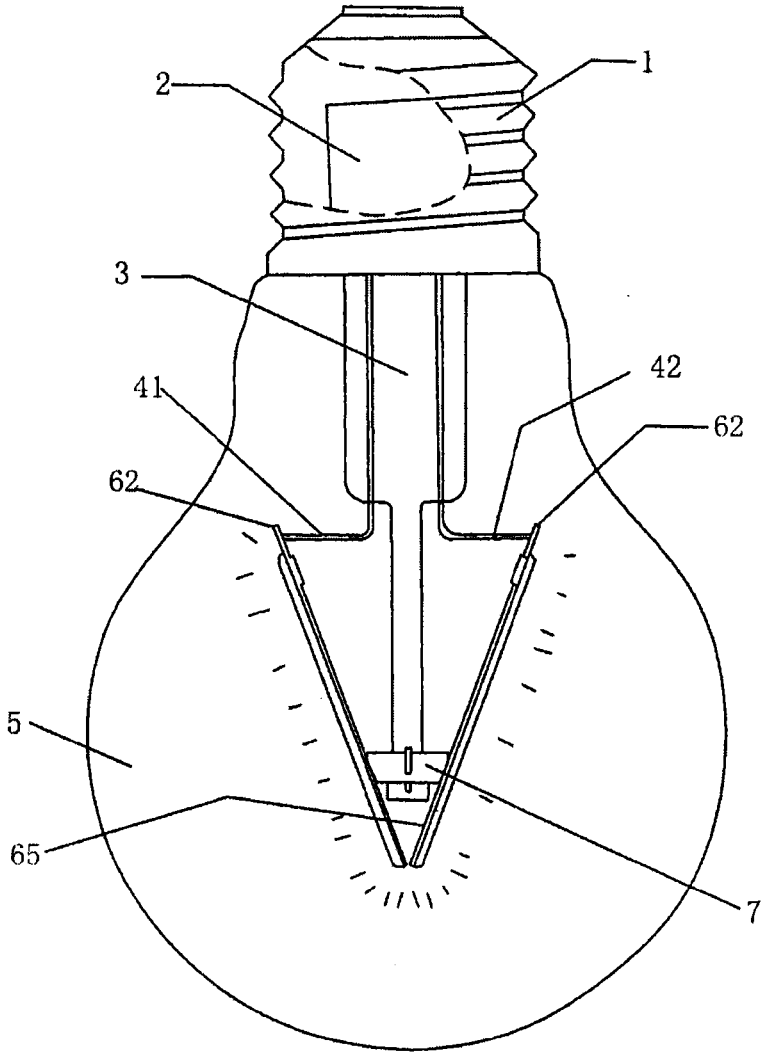
FIG. 4 is a structure diagram of an embodiment provided by LED filament light of the present invention.

Continually as shown in FIG. 2 and FIG. 4, an LED filament light of an embodiment of the present invention comprises a lamp cap 1, an LED power supply 2 installed inside the lamp cap 1, a glass bulb 5, a glass stem 3 fixedly in the glass bulb 5 and embedded with a positive wire 41 and a negative wire 42, and a plurality of LED filaments 6 electrically connected to the positive wire 41 and the negative wire 42 and fixedly on the glass stem 3 respectively, the LED filament is the LED filament 6 shown in FIG. 2, and the LED filament comprises a plurality of light-emitting chips 61, a metal electrical terminal 62, a fluorescent glue 63, an insulating substrate 64 and an electrically and magnetically conductive connector 65; the plurality of light-emitting chips 61 are connected in series, and encapsulated and fixed on a surface of the insulating substrate 64 by the fluorescent glue 63, one face of the electrically and magnetically conductive connector 65 is bonded the other surface of the insulating substrate 64; the metal electrical terminal 62 is electrically connected to a light-emitting chip 61 at one end of the insulating substrate 64, and the electrically and magnetically conductive connector 65 is electrically connected to the light-emitting chip 61 at the other end of the insulating substrate 64. Preferably, the metal electrical terminal 62 is connected to a light-emitting chip 61 at one end of the insulating substrate 64 by a wire 66; preferably, the electrically and magnetically conductive connector 65 is connected to the light-emitting chip 61 at the other end of the insulating substrate 64 by another wire 66. Preferably, the electrically and magnetically conductive connector 65 is rectangle; and the LED filament further comprises an insulating seat 67, one side of the insulating seat 67 is fixedly connected to the metal electrical terminal 62, and the other side of the insulating seat 67 is fixedly connected to the electrically and magnetically conductive connector 65. One side of the insulating seat 67 is provided with a mounting slot 671, and the other end of the insulating seat 67 is provided with is provided with another mounting slot 672, the metal electrical terminal 62 is embedded with the mounting groove 671, and one end of the electrically and magnetically conductive connector 65 is embedded with the mounting slot 672, The LED filament light further comprises an anode LED filament group and a cathode LED filament group, and one electric terminal of the LED filament 6 of the anode LED filament group is electrically connected to the positive wire 41. Preferably, the electric connection is rigid soldering, and the connection of the LED filament 6 is more stable by rigid soldering. One electric terminal of the LED filament of the cathode LED filament group is electrically connected to the negative wire 42, and the anode LED filament group and the cathode LED filament group are symmetrically arranged; the LED filament further comprises a permanent magnet 7, and the other electric terminal of the LED filaments of the anode group and the electric terminal of the LED filaments of the cathode group are connected in series by magnetic attraction via the permanent magnet 7 and the electrically and magnetically conductive connector 65.

Figure 10:
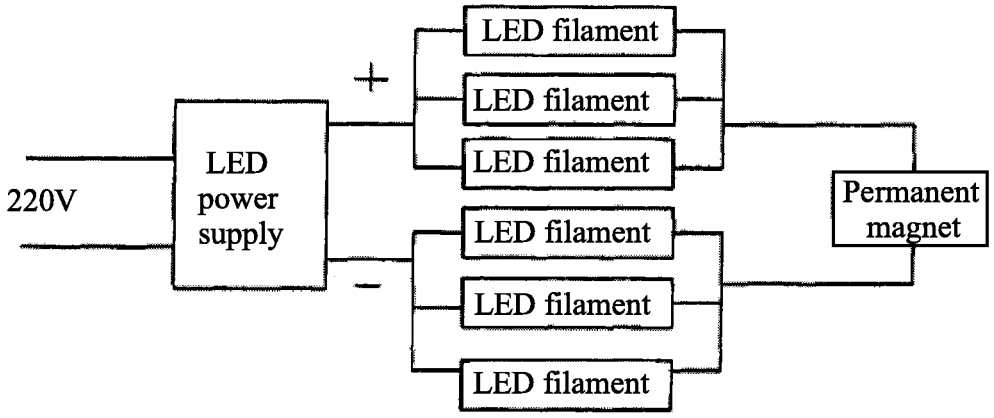
FIG. 10 is a circuit theory diagram of LED filament light of the present invention.
Figure 11:
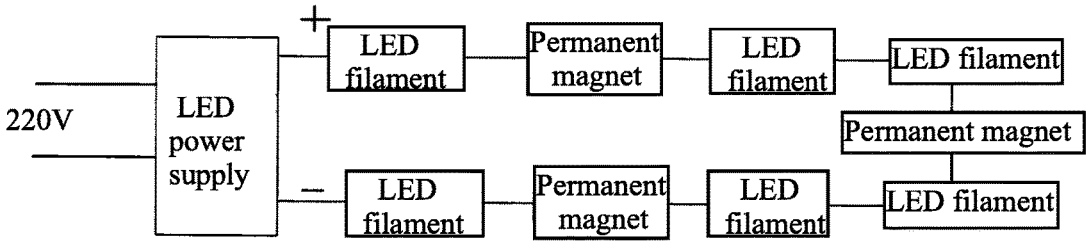
FIG. 11 is another circuit theory diagram of LED filament light of another the present invention.

As shown in FIG. 10, the anode LED filament group comprises at least two LED filaments in parallel, and the other electric terminal of the at least two LED filaments in parallel of the anode group and the electric terminal of the at least two LED filaments in parallel of the cathode group are connected in series by the permanent magnet 7. After 220V AC main are transformed and rectified by the LED power supply 2 in the lamp cap 1, three LED filaments are connected on the anode circuit and the cathode circuit in parallel respectively, and then are connected in series by one permanent magnet.

Preferably, a surface of the permanent magnet 7 is coated with a conductive layer. The conductive layer is a copper layer or a silver layer.

The metal electrical terminal 62 of a plurality of LED filaments 6 are close to one end of the lamp cap 1, the LED filament 6 of the anode group is rigidly connected to the positive wire 41 embedded on the glass stem 3 by spot welding, and the LED filament 6 of the cathode group is rigidly connected to the negative wire 42 embedded on the glass stem 3 by spot welding; the electric terminal away from the lamp cap 1 of the anode LED filament group and the cathode LED filament group, that is, the electrically and magnetically conductive connector 65 adopts the permanent magnet 7 to pull in and fix, and meanwhile, the circuit connection is also connected by the permanent magnet 7. Various filaments are pulled into a cone form to be hidden into a cone body by the permanent magnet 7 and the electrically and magnetically conductive connector 65, and one end free from electric terminal for soldering is pulled into a top end of a conical body, the top end of a conical luminous body also has luminous efficacy. The glass stem 3 and the whole conical luminous body are encapsulated in the glass bulb 5, thereby forming an LED filament light with uniform three-dimensional light illumination effect.

Figure 5:
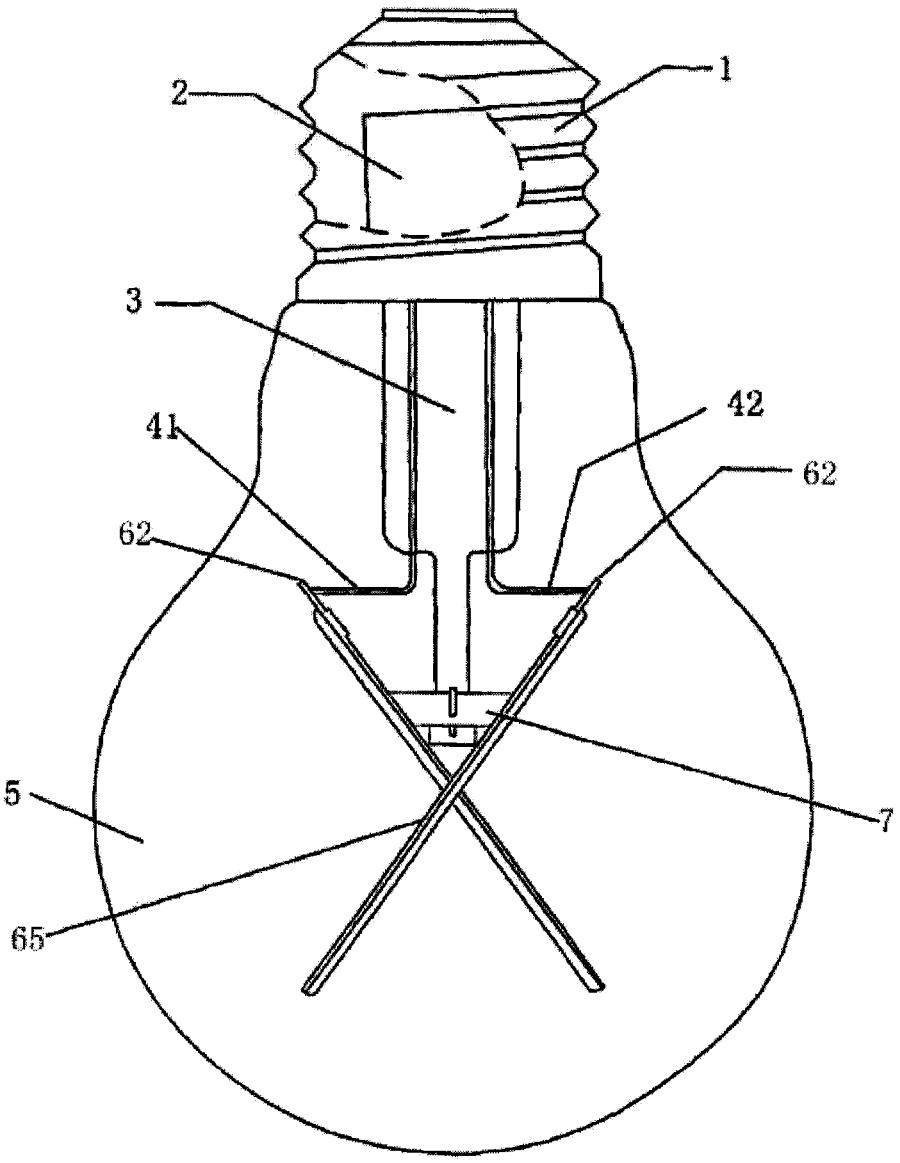
FIG. 5 is a structure diagram of another embodiment provided by LED filament light of the present invention.

Furtherly, as shown in FIG. 5, as an improvement of the technical scheme of above embodiment, the plurality of LED filaments 6 are arranged extending from a top end of a conical body, so that the filaments are cross distribution, thereby forming an LED filament light with better light shape.

Figure 6:
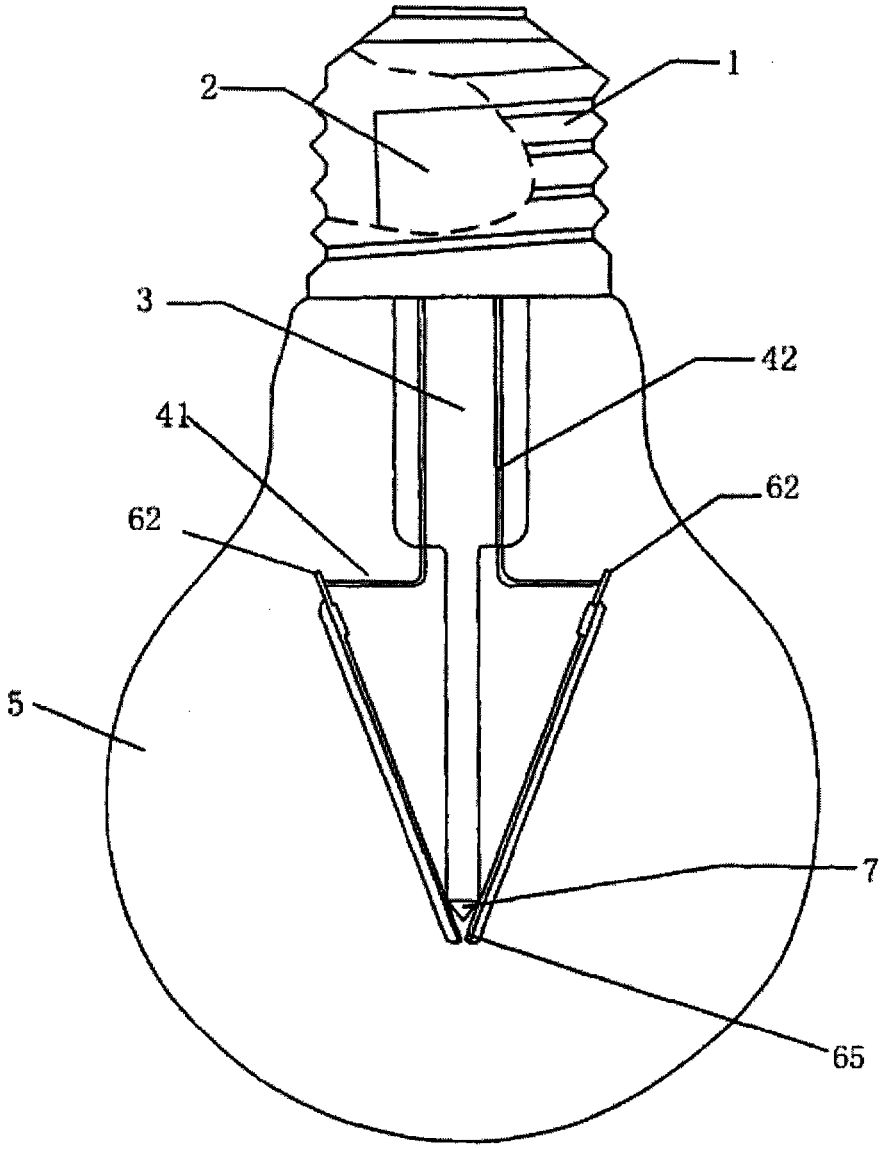
FIG. 6 is a structure diagram of another embodiment provided by LED filament light of the present invention.
Figure 7:
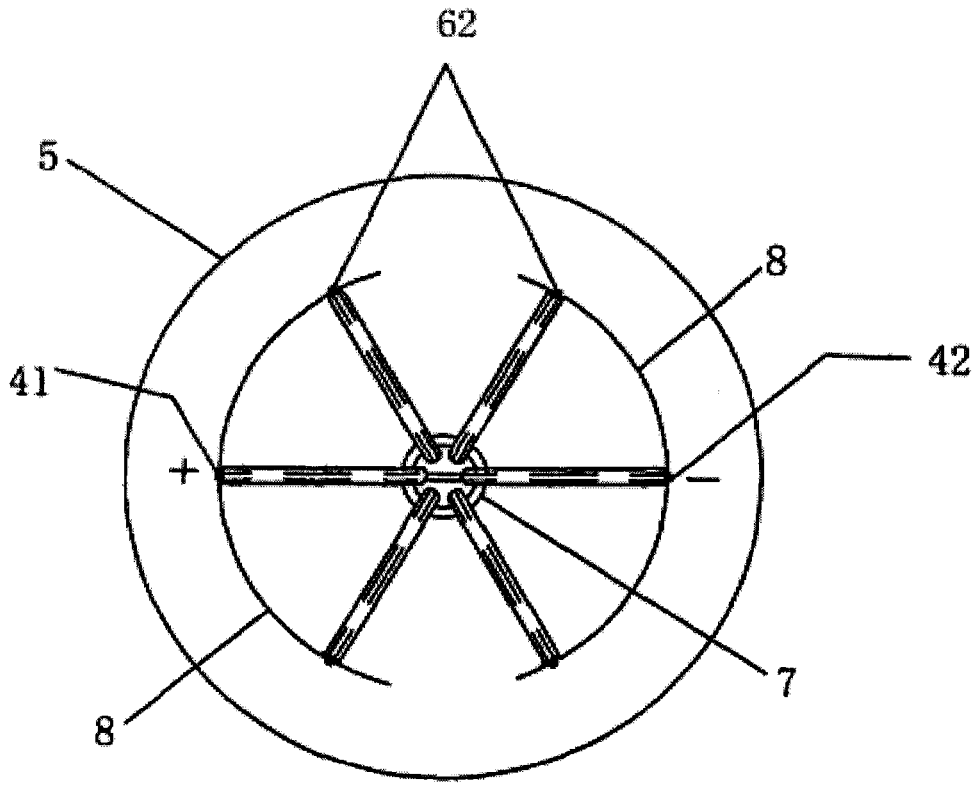
FIG. 7 is a bottom view of FIG. 6.

Continually as shown in FIG. 3, FIG. 6 and FIG. 7, an LED filament light of another embodiment of the present invention comprises a lamp cap 1, an LED power supply 2 installed inside the lamp cap 1, a glass bulb 5, a glass stem 3 fixedly in the glass bulb 5 and embedded with a positive wire 41 and a negative wire 42, and a plurality of LED filaments 6 electrically connected to the positive wire 41 and the negative wire 42 and fixedly on the glass stem 3, and the LED filament is as shown in FIG. 3. The electrically and magnetically conductive connector 65 of the LED filament is provided with a first clamping slot 651, and the metal electrical terminal 62 is provided with a second clamping slot 621; one end portion of the insulating substrate 64 is arranged in the first clamping slot 651 and the other end portion of the insulating substrate 64 is arranged in the second clamping slot 621. The LED filament light further comprises an anode LED filament group and a cathode LED filament group, and one electric terminal of the LED filament 6 of the anode LED filament group is electrically connected to the positive wire 41. Preferably, the electric connection is rigid soldering, and the connection of the LED filament 6 is more stable by rigid soldering. One electric terminal of the LED filament of the cathode LED filament group is electrically connected to the negative wire 42, and the anode LED filament group and the cathode LED filament group are symmetrically arranged; the LED filament further comprises a permanent magnet 7, and the other electric terminal of the LED filaments of the anode group and the electric terminal of the LED filaments of the cathode group are connected in series by magnetic attraction by the permanent magnet 7 through the electrically and magnetically conductive connector 65.

As shown in FIG. 10, the anode LED filament group comprises at least two LED filaments in parallel, and the other electric terminal of the at least two LED filaments in parallel of the anode group and the electric terminal of the at least two LED filaments in parallel of the cathode group are connected in series by the permanent magnet 7. After 220V AC main are transformed arid rectified by the LED power supply 2 in the lamp cap 1, three LED filaments are connected on the anode circuit and the cathode circuit in parallel respectively, and then are connected in series by one permanent magnet.

Preferably, a surface of the permanent magnet 7 is coated with a conductive layer, The conductive layer is a copper layer or a silver layer.

Figure 8:
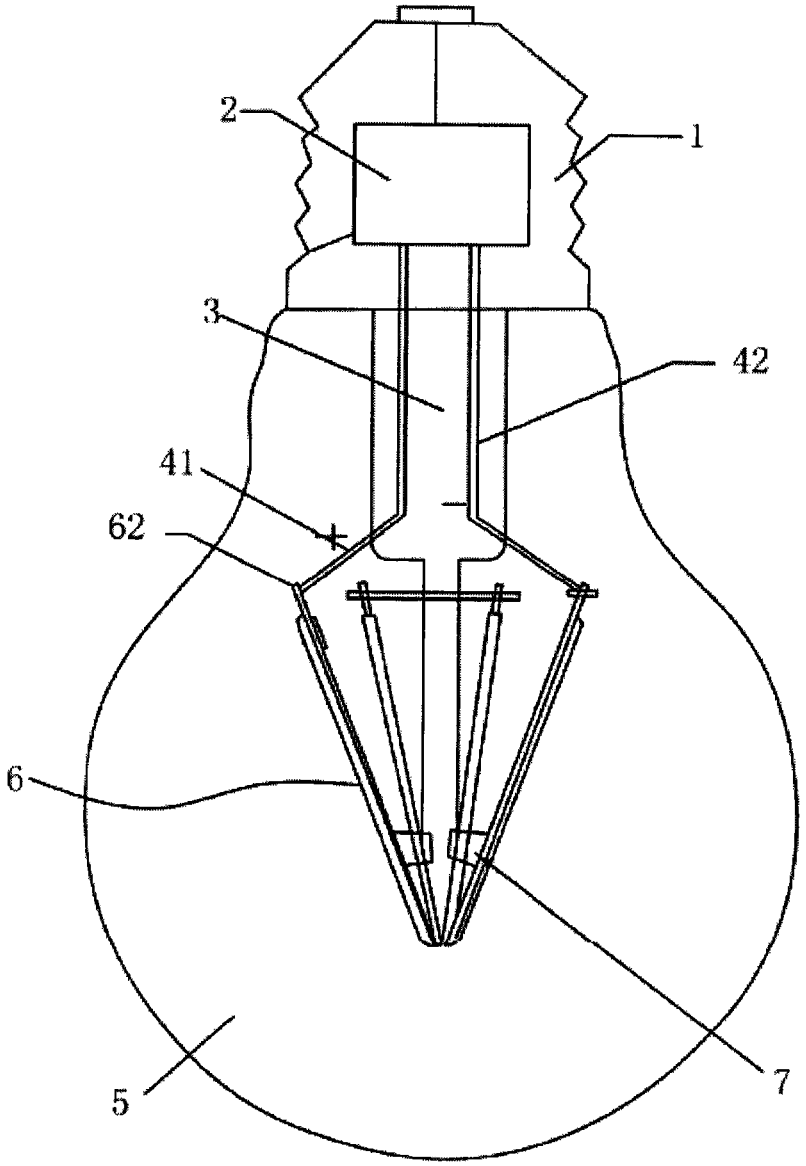
FIG. 8 is a structure diagram of another embodiment provided by LED filament light of the present invention.
Figure 9:
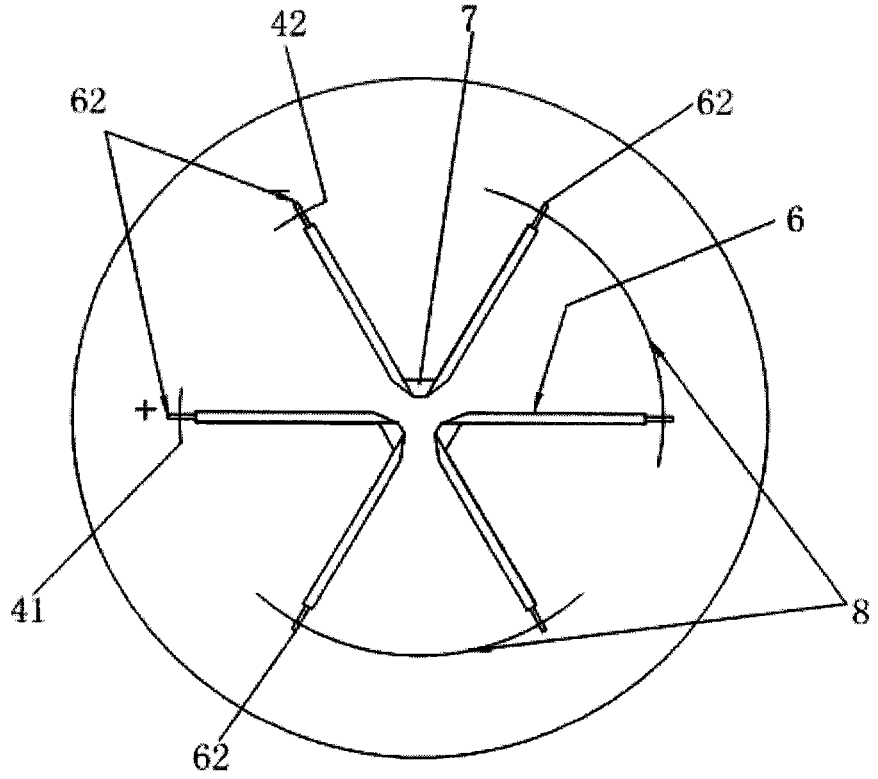
FIG. 9 is a bottom view of FIG. 8.

Continually as shown in FIG. 8, FIG. 9 and FIG. 10, as another embodiment, the LED filament light further comprises at least two permanent magnets 7, and the other ends away from the lamp cap 1 of a pair of LED filaments 6 are connected in series by magnetic attraction by each of the permanent magnet 7 through the electrically and magnetically conductive connector 65; one metal electrical terminal 6 of one pair of LED filaments are electrically connected to the positive wire 41, and one metal electrical terminal of another pair of LED filaments are electrically connected to the negative wire 42, and other two adjacent pairs of metal electrical terminal 62 are electrically connected by a wire 8. The at least two permanent magnets 7 are insulated with each other. Preferably, the number of permanent magnet is three. The number of the permanent magnet 7 is n, the number of the LED filaments 6 connected in series is n, and n is a nature integer greater than or equal to two. Preferably, a surface of the permanent magnet 7 is coated with a conductive layer. The conductive layer is a copper layer or a silver layer.

In conclusion, the LED filaments of the anode group and the cathode group of the LED filament light are distributed circularly, and anode group and the cathode group are arranged symmetrically, so that shades and a weak light region are not generated in a light illumination direction.

An LED filament light of the present invention is magnetically and movably connected, so that LED filaments have free slipping and adjusting function when the lamp filaments are thermally expanded and extended, thereby overcoming the problem of shortened service life due to repeated bending deformation of the LED filaments. Besides, the spot welding connection of one end of the LED filaments and multi-point soldering of a plurality of LED filaments connected in parallel and in series are replaced by permanent to attraction connection, thereby simplifying the manufacturing process.

Particularly, the common spot welding part with non-luminance and light blocking of one end of the LED filament away from the lamp cap is cancelled, and the top end of a conical luminous body also has luminous efficacy, so that a shadow and a Weak light region are prevented from being generated in the lighting direction, so as to obtain an LED filament light with a uniform three-dimensional lighting effect.

Furtherly, the plurality of LED filaments are arranged extending from a top end of a conical body, so that the filaments are cross distribution, thereby forming an LED filament light with better light shape.

Above disclosure are merely some preferred embodiments of the present invention. It should be noted that any variations and modifications based on the invention concept that may come into the mind of those ordinary in the art shall fall into the protection scope of the present invention.

What is claimed is:

1. An LED filament, comprising:

a plurality of light-emitting chips (61), a metal electrical terminal (62) and a fluorescent glue (63), wherein the LED filament further comprises an insulating substrate (64) and an electrically and magnetically conductive connector (65); the plurality of light-emitting chips (61) are connected in series, and encapsulated and fixed on a surface of the insulating substrate (64) by the fluorescent glue (63), one face of the electrically and magnetically conductive connector (65) is bonded the other surface of the insulating substrate (64); the metal electrical terminal (62) is electrically connected to a light-emitting chip (61) at one end of the insulating substrate (64), and the electrically and magnetically conductive connector (65) is electrically connected to the light-emitting chip (61) at the other end of the insulating substrate (64).

2. The LED filament according to claim 1, characterized in that the electrically and magnetically conductive connector (65) is strip-shaped.

3. The LED filament according to claim 1, characterized in that the LED filament further comprises an insulating seat (67), one side of the insulating seat (67) is fixedly connected to the metal electrical terminal (62), and the other side of the insulating seat (67) is fixedly connected to the electrically and magnetically conductive connector (65).

4. The LED filament according to claim 1, characterized in that the electrically and magnetically conductive connector (65) is provided with a first clamping slot (651), and the metal electrical terminal (62) is provided with a second clamping slot (621); one end portion of the insulating substrate (64) is mounted in the first clamping slot (651) and the other end portion of the insulating substrate (64) is mounted in the second clamping slot (621).

5. An LED filament light, comprising a lamp cap (1), an LED power supply (2) installed inside the lamp cap (1), a glass bulb (5), a glass stem (3) fixed in the glass bulb (5) and embedded with a positive wire (41) and a negative wire (42), and a plurality of LED filaments (6) electrically connected to the positive wire (41) and the negative wire (42) and fixedly on the glass stem (3), characterized in that the plurality of LED filaments (6) are the LED filament (6) of claim 1, and the LED filament (6) comprises an anode LED filament group and a cathode LED filament group; one electric terminal of the LED filament (6) of the anode LED filament group is electrically connected to the positive wire (41), the electric terminal of the LED filament (6) of the cathode LED filament group is electrically connected to the negative wire (42), and the anode LED filament group and the cathode LED filament group are symmetrically arranged; the LED filament light further comprises a permanent magnet (7), and the other electric terminal of the LED filament (6) of the anode group and the other electric terminal of the LED filament (6) of the cathode group are connected in series by magnetic attraction by the permanent magnet (7) through the electrically and magnetically conductive connector (65).

6. The LED filament light according to claim 5, characterized in that the anode LED filament group comprises at least two LED filaments in parallel, and the other electric terminal of the at least two LED filaments in parallel of the anode group and the electric terminal of the at least two LED filaments in parallel of the cathode group are connected in series by the permanent magnet (7).

7. The LED filament light according to claim 5, characterized in that a surface of the permanent magnet (7) is coated with a conductive layer.

8. The LED filament light according to claim 7, characterized in that the conductive layer is a copper layer or a silver layer.

9. The LED filament light according to claim 5, characterized in that the LED filaments (6) of the anode LED filament group and the cathode LED filament group are annularly distributed.

10. The LED filament light according to claim 5, characterized in that the plurality of LED filaments are extended from a top end of a conical body, so that the filaments are cross distribution.

11. An LED filament light, comprising a lamp cap (1), an LED power supply (2), a glass bulb (5), a glass stem (3) fixedly in the glass bulb (5) and embedded with a positive wire (41) and a negative wire (42), and a plurality of LED filaments (6) electrically connected to the positive wire (41) and the negative wire (42) and fixedly on the glass stem (3), characterized in that the plurality of LED filaments (6) are the LED filament (6) of claim 1, one end provided with a metal electrical terminal (62) for welding is arranged close to the lamp cap (1), and the LED filament light further comprises at least two permanent magnets (7), and the other ends away from the lamp cap (1) of a pair of LED filaments (6) are connected in series by magnetic attraction by each of the permanent magnet (7) through the electrically and magnetically conductive connector (65); one metal electrical terminal (6) of one pair of LED filaments are electrically connected to the positive wire (41), and one metal electrical terminal of another pair of LED filaments are electrically connected to the negative wire (42), and other two adjacent pairs of metal electrical terminal (62) are electrically connected by a wire (8).

12. The LED filament light according to claim 11, characterized in that the at least two permanent magnets (7) are insulated with each other.

13. The LED filament light according to claim 11, characterized in that the number of the permanent magnet is n, the number of the filaments connected in series is n; wherein n is a nature integer greater than or equal to two.

14. The LED filament light according to claim 11, characterized in that a surface of the permanent magnet (7) is coated with a conductive layer.

15. The LED filament light according to claim 14, characterized in that the conductive layer is a copper layer or a silver layer.

16. The LED filament light according to claim 11, characterized in that the LED filaments (6) are annularly distributed.

* * * * *